US006422917B1

(12) United States Patent
Rose et al.

(10) Patent No.: US 6,422,917 B1
(45) Date of Patent: Jul. 23, 2002

(54) THERAPEUTIC BRASSIERE

(75) Inventors: Casandra Rose, Naples, FL (US); Vernon Goff, III, New York City, NY (US)

(73) Assignee: E'lan Vital Designs LLC, Milwaukee, WI (US)

( * ) Notice: Subject to any disclaimer, the term of this patent is extended or adjusted under 35 U.S.C. 154(b) by 0 days.

(21) Appl. No.: 09/539,339

(22) Filed: Mar. 31, 2000

(51) Int. Cl.[7] ..... A41C 3/00
(52) U.S. Cl. ..... 450/65; 450/1; 450/86
(58) Field of Search ..... 450/1, 59, 62, 450/63, 65, 66, 79, 85, 86

(56) References Cited

U.S. PATENT DOCUMENTS 525,241 A * 8/1894 Tucek ..... 450/1
1,290,608 A * 1/1919 Lowman ..... 450/86
2,455,036 A * 11/1948 Boylan ..... 450/86
3,008,468 A * 11/1961 Williams ..... 450/86
3,465,754 A * 9/1969 Lockwood et al. ..... 450/86
5,823,852 A * 10/1998 Chei ..... 450/38

* cited by examiner

*Primary Examiner*—Gloria M. Hale

(57) ABSTRACT

A therapeutic brassiere is disclosed being constructed of a one piece directional elastic material. The direction of elasticity of the material is more stretchable in the up and down direction than the lateral direction as seen from the front of the wearer, the elastic material includes self-forming cups when worn by a person. Each of the cups has an apex from which shoulder straps emanate to pass over the shoulder of the wearer to cross in the back and being attached to lateral edges on the opposite side of the brassiere. At the lateral sides of the brassiere, fasteners are placed which fasten to corresponding fastener located on the shoulder straps. The shoulder straps are widened at their ends and are also reinforced at that location. The cups receive pads in the shape of a tear drop with the major part of the shape of the tear drop being located at the lateral sides of the brassiere. The shoulder straps, as they cross in the back of the wearer, are pulled down so that they are caused to cross at the small of the back of the wearer.

11 Claims, 8 Drawing Sheets

THERAPEUTIC BRASSIERE

BACKGROUND OF THE INVENTION

This invention pertains to an improved brassiere, hereinafter referred to as the Women's Support System (WSS), that aids in the support of the breast by taking into consideration that the body is an electrical unit, composed of a community of atoms, in addition to the mechanical form; whereas the muscle tissue in the breast and the back of the wearer along with corresponding ligaments meridian channel acupressure points, nerve endings, the lymphatic system, mammary glands, and the epidermal layer of the body are stimulated and thus activated.

DESCRIPTION OF THE PRIOR ART

The invention is referred to WSS for one reason. A brassiere literally means "brace" whereas the WSS is not a brace but a suspension system that naturally lifts and cossets the breast. Brassieres on the market today are made of multiple pieces that are then connected to create a finished product. An example would be today's Wonderbra which has 48 separate pieces in it's construction. This creates instability eliminating proper support. The current trend of conjoining multiple pieces of fabrics with the use of metal or hard plastic under-wires or heavy banding for support and/or shaping of the breasts force the breasts to contour to an unnatural form. Constricting the tissue of the breast thusly inhibits the flow of lymph within the body's cells. Lymph being a clear fluid that bathes all the cells in the body to remove toxins from the body's system and lymph being easily "trapped" within the cells by a gentle application of pressure to any one area. Locking the lymph within the cells of a wearer detains toxins within the body. This fact is a large contributor to disease In addition, the use of constricting materials for the support of the breast inhibits the movement of the wearer. Being that when the body is elongated or stretched, the breasts are held rigid. This opposes the natural flow of the muscles and the tissue of a body in motion contributing to the reduction in the range of motion for the wearer and ultimately to their purported discomfort.

It can also be seen that in existing brassieres, the shoulder straps go directly over the shoulder (the clavicle bone and the scapula muscles) on the same side where each of the breasts is located and is fastened on the back to the body strap, again on the same side. All known brassieres tend to be too irritating after some wear because they go against the natural flow of the muscles. They pull the weight of the breasts that sit on the bony structure of the ribs to the back where most of the back closures of the brassieres press against the spinal column. In this manner the spinal column and the shoulders support the bulk of the weight of the breasts. The result is indicium, curvature of the spine and indentations to the muscles, fat, bone and skin on the shoulders due to straps pulling forward to support this weight. The natural flow of the body structure by way of bones, muscles, ligaments, etc. is to the front of the body. The bony structure of the body cannot support the weight of the breasts, as most brassieres tend to do. Not only does this cause irritation to the bony structure of the body but any fastenings over the spinal column and using the spine for a means of support for the breasts compresses the vertebra which houses the central nervous system. The spine has insufficient muscle mass surrounding it as it "dangles" from the occipital lobe to support this weight creating stress on the back and spine producing pain in the wearer and an interruption in the wearer's energy flow.

Moreover, this a-fore mentioned constraint coupled with the current breasts supporting technique which places the weight of the breasts to the front of the wearer by way of attempting to utilize the shoulders and back for support, directs pressure onto the diaphragm from it's zenith on downward. This pressure inhibits the flow of oxygen into the wearer's body by disallowing the muscle, that is the diaphragm, from performing complete inhalations and exhalations. It is axiomatic, the myriad of problems created for the wearer who is not receiving sufficient oxygen in their system, the least of which is discomfort and the more severe being any of a variety of general maladies.

Additionally, the cups in today's brassieres provide support to the breasts predominately from the breasts' underside. This does not take into consideration that the force of gravity is not an up and down experience located at the afferent front of the wearer. Gravity is a force that is experienced in an arc (curved), it being that the greatest pull is on the breasts from their lateral sides to lateral undersides not the afferent front undersides. Therefore, placing the cups under the breasts does little to aid in their support contributing to a forward pull on the wearer and again aids in the compression of the diaphragm and pull on the shoulders, back and spine. These factors, along with the location of the fasteners, which are over the spinal column or the sternum, contribute to the discomfort of the wearer.

The cumulative nature of the current techniques utilized in brassiere designs breaks down cellular communication, interrupting the flow of energy in the body of the wearer. These problems come into fruition from breaking the inherent synergy between varying bodily systems. The following are prior patents showing the state of the art that pertains to the invention at hand.

U.S. Pat. No. 525,241 issued in 1894 shows two plates made of sheet metal, cardboard or other suitable material. The two plates are laced together in the middle front and two shoulder straps cross each other in the back of a wearer. This in now way can be considered to be a therapeutic brassiere.

U.S. Pat. No. 643,911 shows a brassiere that seems to be a one piece fabric apparel corset that overlaps in the back of a wearer and has side panels which can be moved to the front of the wearer to fastened at that location.

U.S. Pat. No. 719,075 illustrates a brassiere which comprises a soft pliable breast piece which in the front is formed with outward bulges affording pockets to receive and fit the breasts of the wearer. The ends of the breast piece extend backward under the arm and taper to narrow ends provided with buckles, The shoulder straps extend diagonally across the back and over the shoulders on the sides opposite to their secured ends and are adjustably secured to the above mentioned buckles.

U.S. Pat. No. 1,231,011 discloses a brassiere that appears to be made of one piece material. It is designed to support, confine and reduce stout figures. This brassiere certainly could not be called a therapeutic brassiere U.S. Pat. No. 2,052,412 shows a one piece material brassiere in which the shoulder straps pass over the shoulder of the wearer and stay on that side when fastened to the back. The back panels overlap each other and are fastened to the basic fabric just forward of the arms of a wearer.

U.S. Pat. No. 2.156,478 discloses a brassiere having two breast pockets fastened to each other in the front of the wearer to form a one piece. The shoulder straps pass over the shoulders of the wearer and are passed through two rings in the back of the wearer and then pass forwardly to side edges of the brassiere and are fastened there on the same side where the shoulder straps started. In another embodiment, there is a single ring in the back having both shoulder straps pass there through but then diverge therefrom in opposite directions.

U.S. Pat. No. 2,455,036 discloses a two cup brassiere with both cups being connected to each other in the center. The shoulder straps pass through a ring in the back of the wearer as a continuous loop. Another continuous loop passes through the same ring from opposite sides of the cups. The loops are said to be self-adjusting through the ring whenever the wearer moves.

U.S. Pat. No. 3,814,107 illustrates a brassiere that has a pair of padded bust supporting cups including resilient shoulder straps that reach from the apex of each cup to a rear body band and are connected thereto at the same side of each shoulder of a wearer. The padded pads reach completely under each of the breasts, U.S. Pat. No. 4,607,640 discloses a brassiere being provided with thin pockets formed from two layers of fabric with lateral openings to receive protective pads therein as a protection in sporting events. The shoulder straps crisscross at the back of a wearer and are fastened at a body band at the rear of the brassiere.

U.S. Pat. No. 5,221,227 describes a brassiere consisting of a sleeveless bodice type athletic support garment. This garment appears to a compressive brassiere type garment.

U.S. Pat. No. 5,221,227 shows a supportive brassiere designed for general usage, aerobics or other athletic activities and/or nursing. It is designed primarily for athletic use among women with moderate to large breasts. The brassiere is designed with an adjustable side closure and strong, individual, under-breast supports. The brassiere includes a pair of soft cups supported from above by adjustable wide shoulder straps.

U.S. Pat. No. 5,800,245 illustrates a brassiere made of elastic material. the cup assembly is constructed, around the two cups, at least with shoulder straps and side panels which merge into a back panel. The brassiere is provided, on the side next to the body, with a complete lining accessible for compressive pads.

U.S. Pat. No. 5,863,236 shows a brassiere which seems to be made of a one piece of material. It is simply pulled over the head of a wearer because of the presence of shoulder straps that connect like front and back panels. The brassiere is adjustable in its girth by closures having been placed at the sides of the brassiere.

British patent No. 476,196 issued in 1937 discloses a brassiere having two substantially triangular breast receiving pockets united at or adjacent their inner or front ends. A pair of shoulder straps each extends from the apex of one pocket to the outer or rear end of the other or same pocket. The straps are being crossed or threaded through a common ring or the like to produce the effect of crossed straps.

Finally, there is a German patent No. 31,075 issued in 1907 showing breast cups that can be connected at their immediate center. Shoulder straps are adjustably attached at the apex of each of the cups, are guided over of the shoulders of the wearer, are crossed at the back of the wearer through a ring and then are connected to the sides of opposite cups. The main purpose of this brassiere is to place absorbent pads within the cups and is especially designed for nursing mothers.

OBJECTS OF THE INVENTION

It is an object of the invention to alleviate all of the above noted problems and to create a support system for the woman's breast that is non-constricting, comfortable to wear and opens the diaphragm by creating natural lift and suspension whilst not irritating any muscle tissue with their corresponding ligaments, meridian channel acupressure point, nerve endings, the lymphatic system, mammary glands, or epidermal layer of the wearer. To this end, the WSS is constructed from one piece of highly breathable stretch fabric to ensure the wicking of transudation from the wearer's body and has a unique strap cross over, fastener and pad placement feature for equal weight distribution of the breasts. There is a non-binding/non-contouring use of elastics. No hard plastic supports, under-wires or seams are being used that could constrict, contour or irritate the muscle tissue and corresponding ligaments, meridian channel acupressure points, nerve endings, lymphatic system, mammary glands, or epidermal layer. A pad is included that is molded to the actual shape of the breast, starting at the axilla and moving forward encompassing the lateral portion of the breast where it finishes wrapping towards the anterior underside of the breast The pad and fastener placement, in tandem with the strap cross over feature, create a system that acts to suspend the breast while activating the serratus anterior, external obliques, and the intercoastel muscles where they come together at the outside edge of the breasts concentric to the latiisimus dorsi. This fully utilizes the body's structure for the breast support. In this process, secondary stimulation is created to the pectoralis major. The activation of these groups of muscles and the stimulation of the meridian channel the body's structure for the breasts support. In this process, it is creating a secondary stimulation of the meridian channel acupressure points simultaneously gives the body an electrical charge or surge, which when applied to the wearer's breasts, an isometric exercise is created. This is the means of producing the previously referred to as "natural lift". This "lift" takes the weight off from the upper portion of the diaphragm while increasing the muscles' ability to expand and contract to thereby increase the amount of oxygen available to the wearer and allowing the diaphragm to provide the necessary massaging action which is tantamount to the stimulation of the lymphatic vessels. The diaphragm's massaging action is the body's main method of stimulating lymphatic drainage. Also, the weight of the breast is alleviated from the trapezius muscle, coppers ligament, clavicle, scapula, fat and skin of the shoulder, keeping the shoulder free from indentation over time. The unique pads are molded to a distinct shape, as stated above, and placed on the diagonal in proximity to the lateral region of the breasts, to provide support for the breasts where the gravitational pull is the strongest. This particular pad placement conjoined with the fastening area supports, protects and cushions the breast due to their proximity to the region where various muscle tissue and corresponding ligaments, meridian channel, acupressure points, nerve endings, lymphatic system and bone engage, that is, come together.

DETAILED DESCRIPTION OF THE INVENTION

Figure 1:
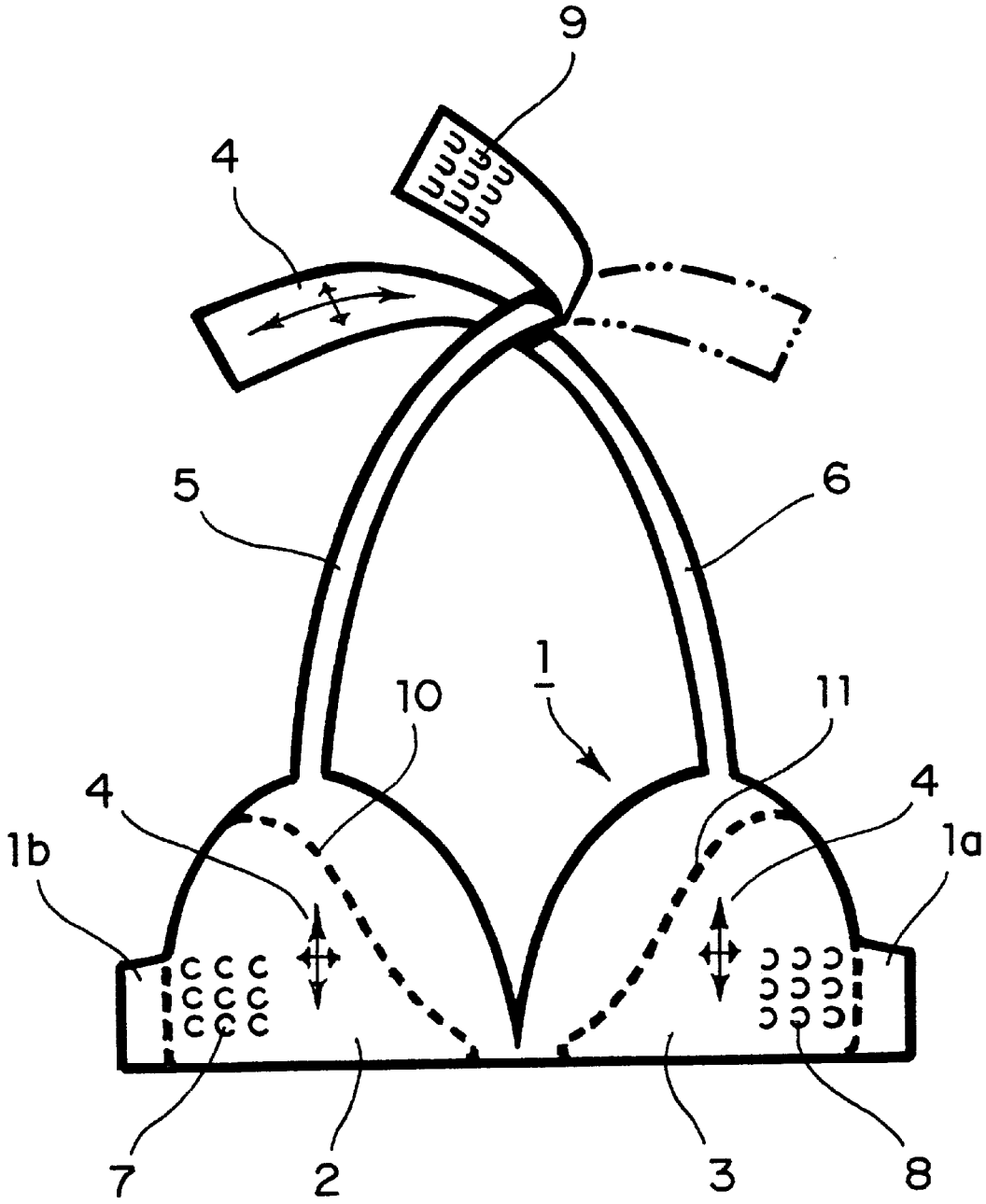
FIG. 1 shows a plan view of the brassiere when laid out flat and its pattern.

FIG. 1 illustrates the pattern of the brassiere when laid out flat and as it would be seen from the front by a viewer standing in front of the model. All other views in subsequent drawings should be viewed in the same manner. The numeral 1 in FIG. 1 shows the pattern as a one piece of material. The material itself is an elastic material having differential elastic characteristics as being depicted by the arrows 4. Thus, the fabric is more extendible in the upward direction of the brassiere than in the sideways direction. Since the bulk or the mass of the breasts of the person wearing the brassiere extends forwardly, the breasts form their own cups, 2 left and 3 right, in the one-way elastic material. Therefore, the brassiere may be applicable to various sizes of wearers. The left breast cup 2 has a shoulder strap 5 that extends from its apex and the right breast cup 3 has the same arrangement with a shoulder strap 6 extending from its apex. The one way elasticity of the fabric is maintained and continued into the shoulder straps as can be seen again at 4 at the end of the right shoulder strap 6. In FIG. 1 and also in subsequent FIGS. The ends of the shoulder straps are widened, the purpose of which will be explained in detail below. The left breast cup 2 has loops 7 attached close to the edge 1*b* of the brassiere and the same arrangement can be seen with loops 8 near the other edge 1*a* of the brassiere. As will be seen in later perspective views, the hooks 9 shown at the end of the left shoulder strap 5 will engage the loops 8 at the end of the brassiere 1*a*. Of course, the same hooks are arranged on the other right shoulder strap 6 (not shown). It should be pointed out at this time that the well known VELCRO™ patches could also be used with equal results. But it is preferred that hook and loops be used because when the brassiere is laundered with other garments, they cannot snag on each other. Also seen in FIG. 1 is the outline 10 of a pad 10 in the left breast cup 2 and an outline 11 of another pad in the right breast cup 3. The shape and the correct placement of these pads will be explained below.

Figure 2:
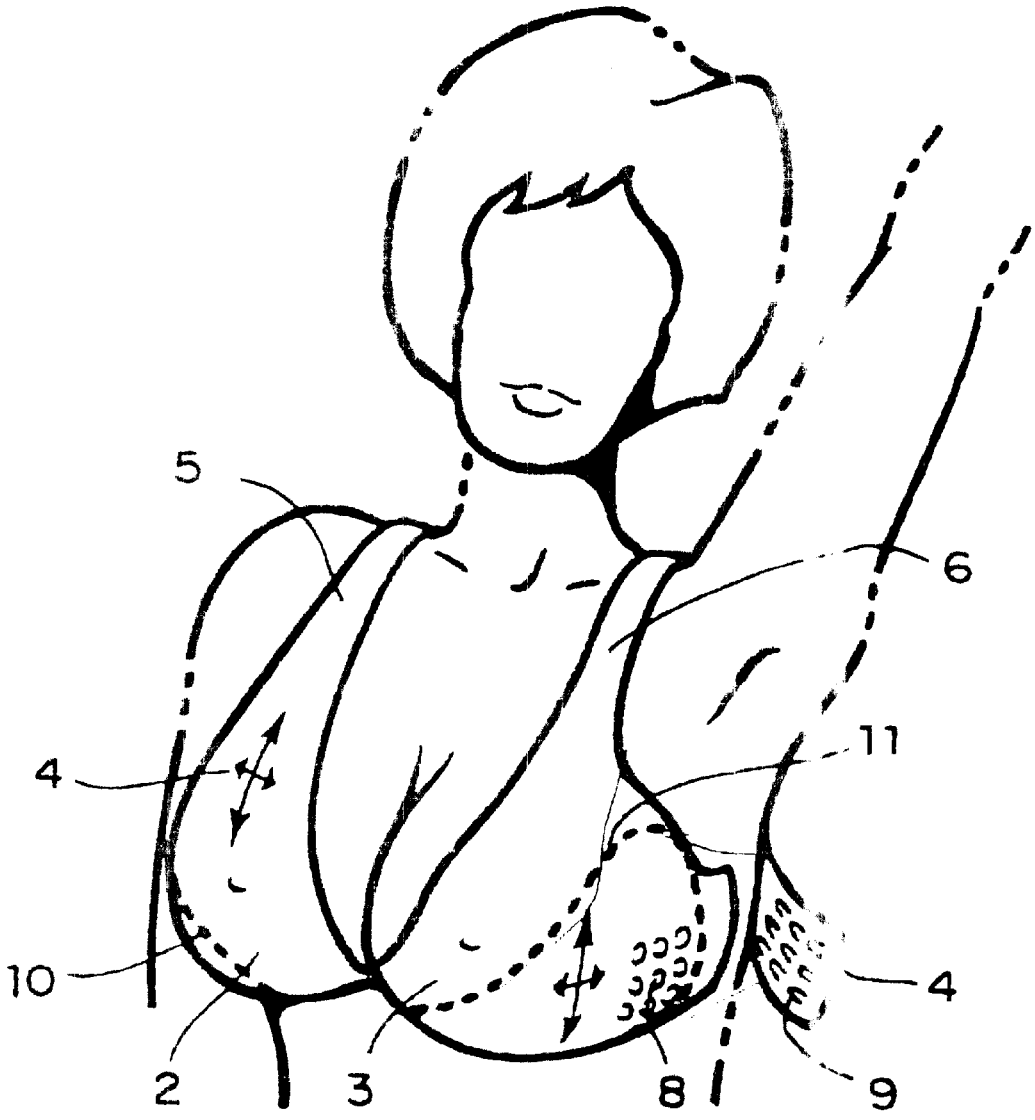
FIG. 2 shows the brassiere in a perspective view as seen on a model.
Figure 3:
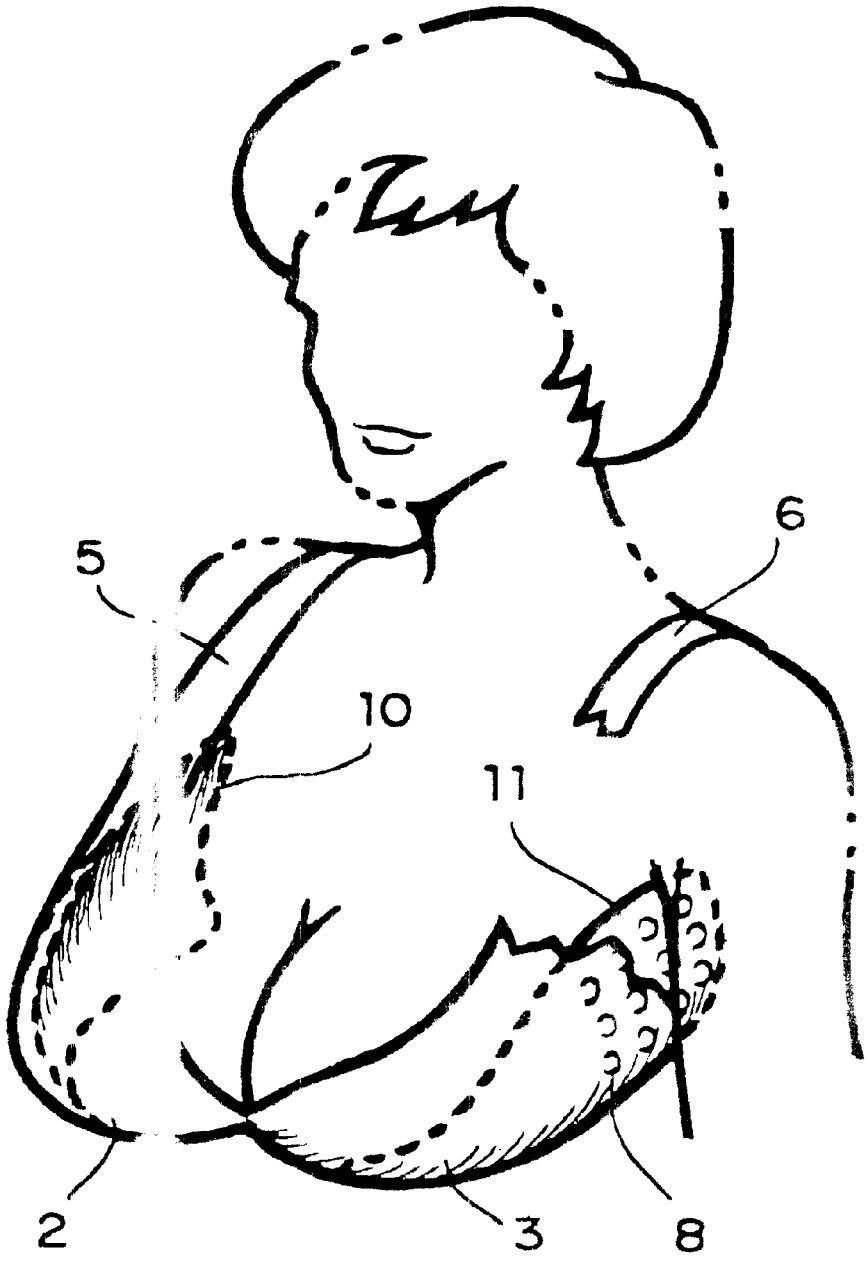
FIG. 3 shows a perspective front view of the brassiere with parts broken away for clarity.

Turning now to FIG. 2 wherein the same reference characters have been placed on the same elements as was explained in FIG. 1. In this FIG. 2, it can be seen that each of the female breasts has found its own cup because of the fabric being more elastic in the upward direction than in the sideways direction. Thereby, the breasts are comfortably supported in the cups 2 and 3 with little compression and without any chafing which could irritate the skin of the wearer. It can also be seen that the brassiere edge 1*a* of the brassiere ends under the armpit of a wearer. It should also be noted that the left cup 2 shoulder strap 5 extends over the left shoulder of the wearer and fastens to the loops 8 at the other side end 1*a* of the brassiere by way hooks 9. Since several rows of loops 8 and hooks 9 are shown, this will allow the shoulder straps 5 and 6 to have some adjustability within a one size of the brassiere. In this FIG. 2 as well as in FIG. 3, the outline of the pads can more clearly be seen. According to the teachings and purposes of many brassieres known in the art, the pads are designed to afford an uplift to the breasts or to push the breasts in such a way to create more of a cleavage. The purpose of the pads is to support the muscles found under and forwardly of the armpit. These muscles are the so-called Pectoralis major muscles which run from the spinal area to the side area of a person where in this region they are called the latissimus dorsi muscles. The pads 10 and 11 have a shape to resemble a tear drop with the major part of the tear drop being located just forward of the arm pits. This is exactly where the latissimus dorsi muscles are located. Also, this is where the lateral sides 1*a* and 1*b* of the brassiere are located and this is also where the fastening elements, the loops 8 are located. As mentioned above, the ends of the shoulder straps 5 and 6 are widened at their ends (FIG. 1). This then all results in a support system below the arm pit of the person and just forward of the same. It can now be seen that the pads 10 and 11 are not designed as push-up pads to enhance the appearance of the female breast contour but is designed to stimulate the muscles at the location mentioned above. This stimulating effect will be further explained below.

Figure 4:
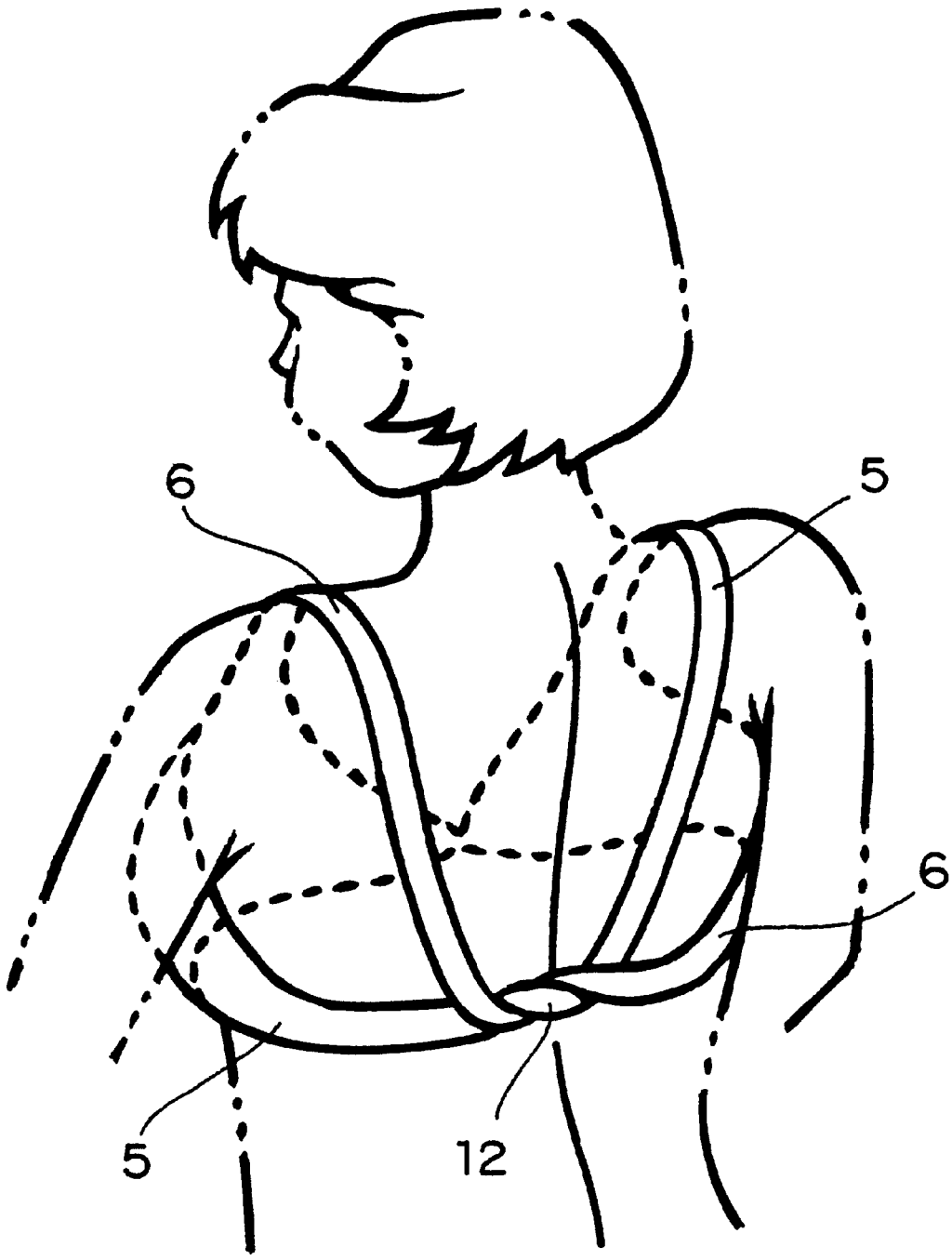
FIG. 4 illustrates a back view of the brassiere with shoulder straps being intertwined with each other.

Turning now to FIG. 4, the brassiere is shown as seen from the back of the model. It can now be seen that the strap 5 from the left side of the wearer passes over the left shoulder of the wearer, crosses in the back and is fastened to the outside edge 1*a* of the right breast. At the same time, the right shoulder strap 6 passes over the right shoulder of the wearer, also crosses the back and is fastened to the outside edge 1*b* of the left breast. Experiments have shown that, if the shoulder straps 5 and 6 crossing in the back of a wearer were left to their own design, they would be crossing each other at a point that is too high on the spine. It is preferred that the shoulder straps cross each other at a location that is lower on the back, such as the small of the back and to form a line of support that is in line with the above mentioned pectoralis major muscle or superposed over the same. A simple solution can be seen in FIG. 4, where the two shoulder straps 5 and 6, as they pass over their respective shoulders, are intertwined with each other prior to being fastened at the respective outer ends 1*a* and 1*b* of the brassiere. The intertwined or wrapped around each other straps can clearly be seen at 12 in FIG. 4.

Figure 5:
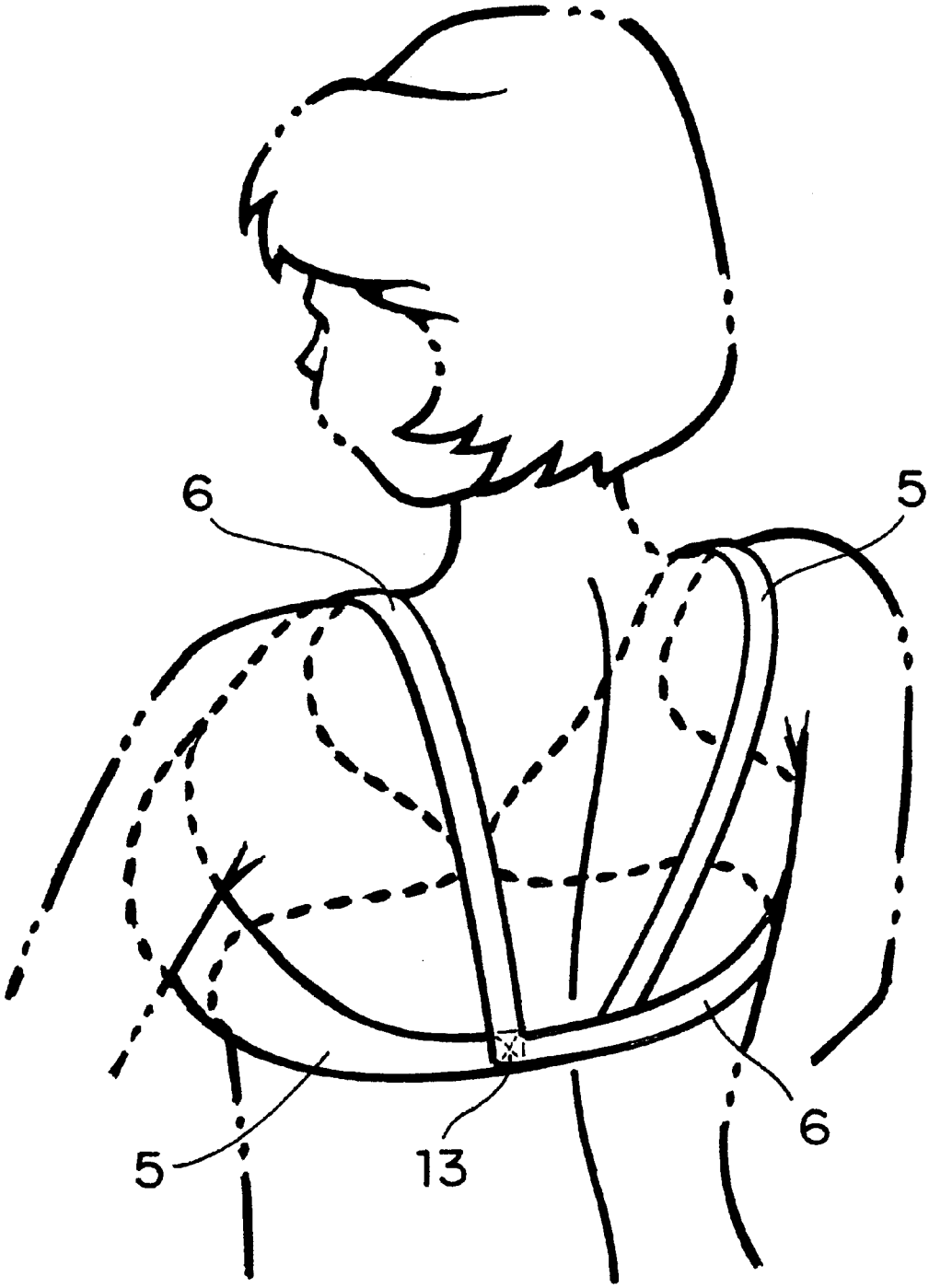
FIG. 5 is a back view of the brassiere wherein the shoulder straps are fastened to each other but on opposite straps and in a narrow spacing.
Figure 6:
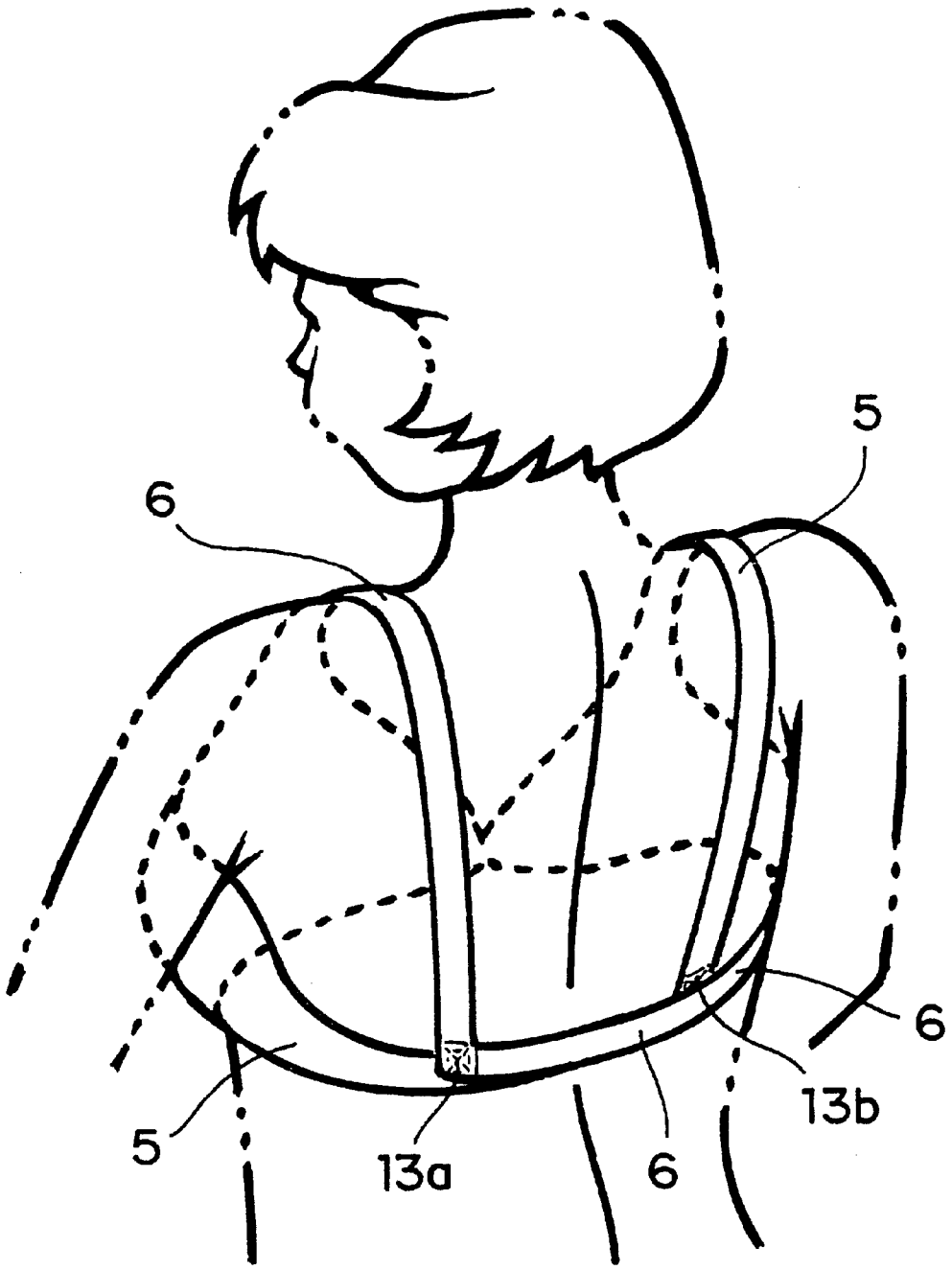
FIG. 6 is the same view as shown in FIG. 5 but showing the shoulder straps in a wide spacing.

Turning now to FIGS. 5 and 6, The crossing of the shoulder straps 5 and 6 has been more stabilized by fastening one shoulder strap to the other one first before being fastened to a respective side of the brassiere. Thus, for example, the right shoulder strap 6 is passing over the right shoulder (all as seen from the front) and is then fastened at 13*a* to the other shoulder strap 5 that passed from the left shoulder. The same arrangement can be seen for the left shoulder strap 5 that is passing over the left shoulder and is first fastened at 13*b* before being fastened to the outer edge 1*b* (not shown in this Fig.) of the brassiere. The only difference between FIGS. 5 and 6 can seen in that the spacing between the points of fastening 13*a* and 13*b* is wider in FIG. 6 than the spacing in FIG. 5. The selection of one over the other depends largely on the size of the person and the size of the upper torso of the wearer.

Figure 7:
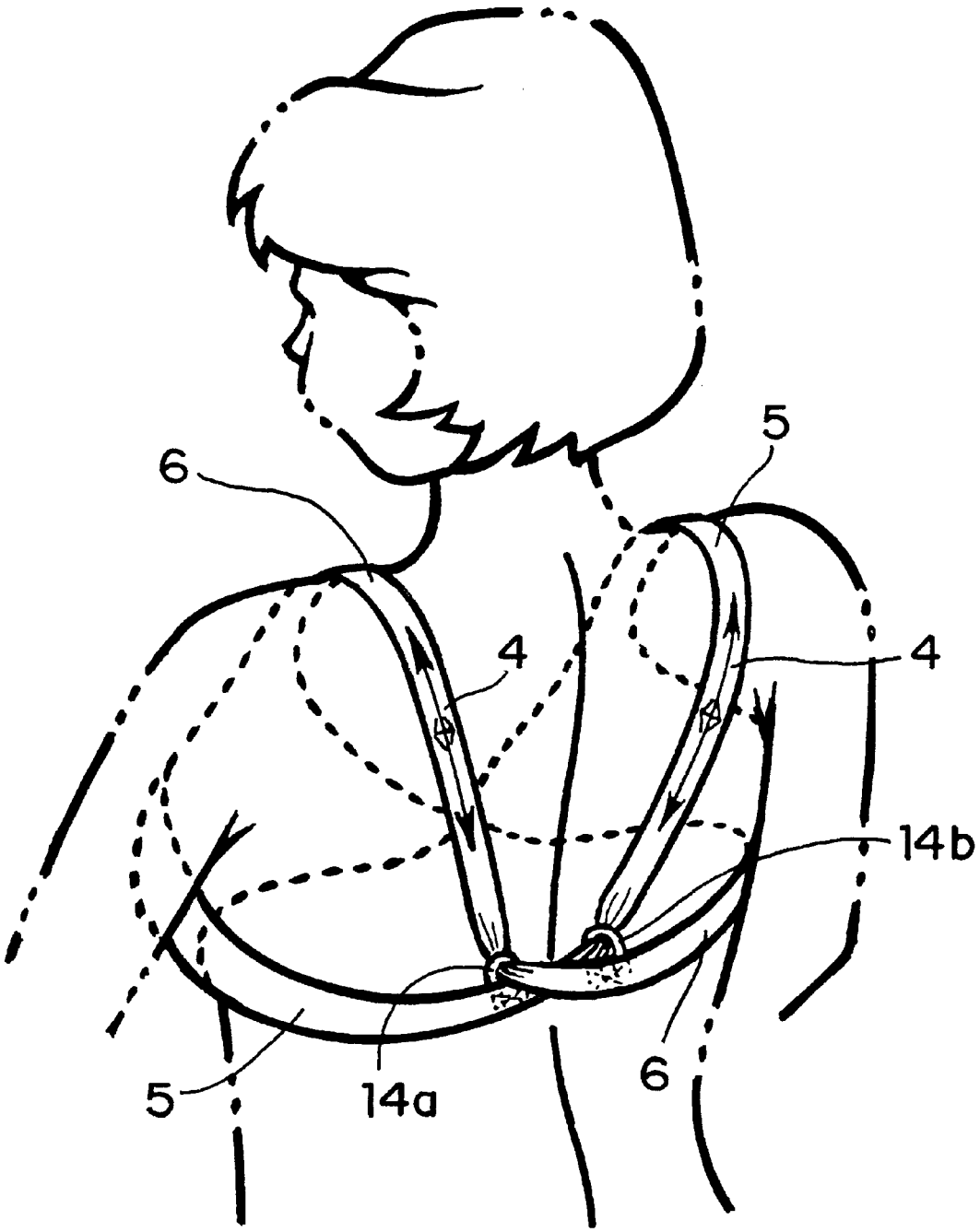
FIG. 7 is a back view of the brassiere wherein the shoulder straps are slidably connected to each other again on opposite straps and in a narrow spacing.
Figure 8:
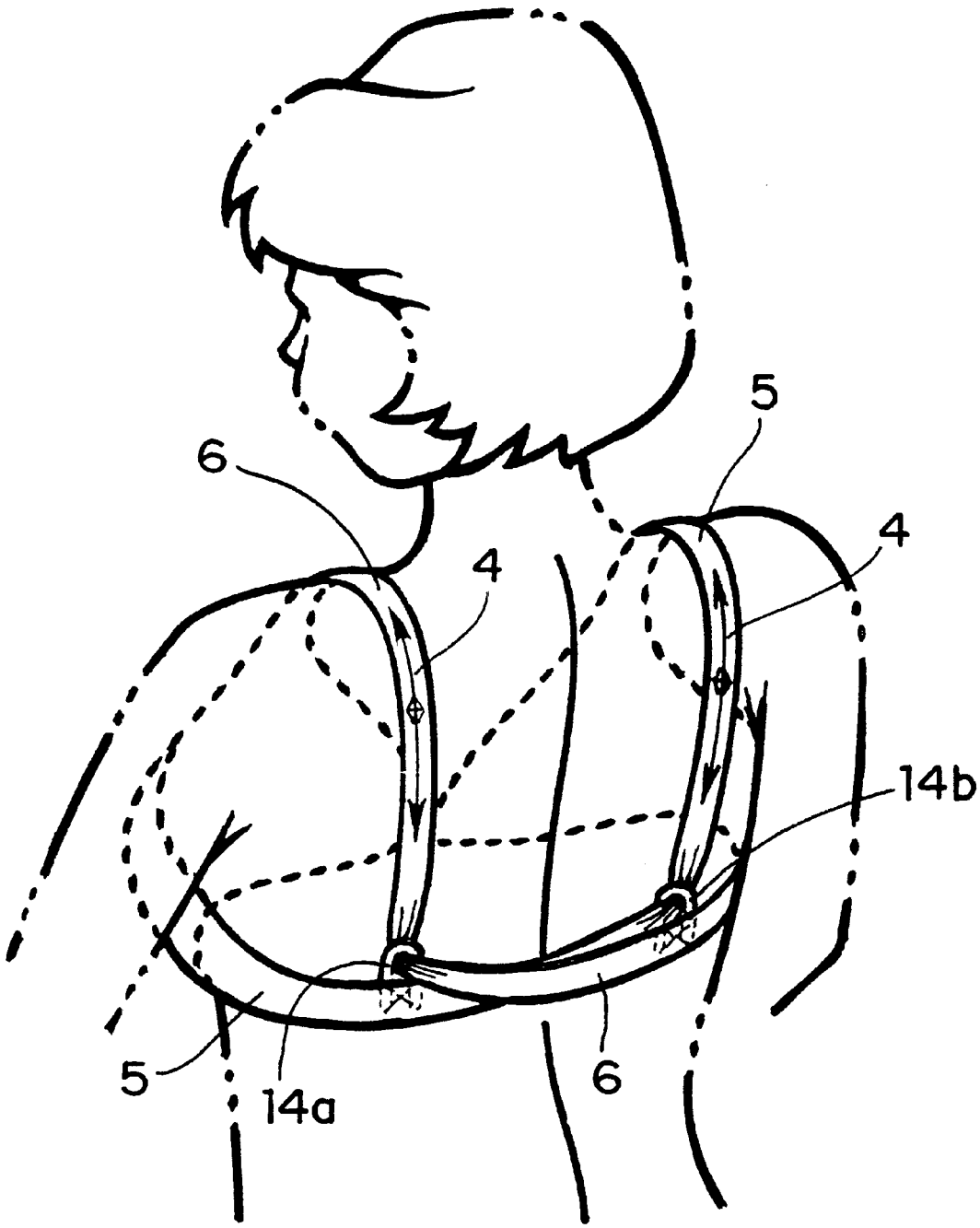
FIG. 8 is the same view as shown in FIG. 7 in a wide spacing.

FIGS. 7 and 8 show another way of fastening the shoulder straps 5 and 6 to each other. This embodiment allows for some self-adjusting of the shoulder straps relative to each other and the structure of the brassiere. For this purpose, rings, such as D-rings 14*a* and 14*b*, are fastened to the respective shoulder straps in the region of the back of the wearer. For example, the left shoulder strap 5, which passes over the left shoulder of the wearer will first pass through the ring 14*b* and then will be fastened to the right side edge 1*a* of the brassiere. The right shoulder strap 6 passes over the right shoulder of the wearer, then through the ring 14*a* which is fastened to the other shoulder strap and then is fastened to the left edge 1*b* of the brassiere. All the orientations are seen from the front as shown in FIG. 1. The difference between FIG. 7 and FIG. 8 again is the difference in spacing between the rings 14*a* and 14*b* as was the difference in spacing as shown in FIGS. 5 and 6 where the respective straps were fastened to each other. Again the spacing depends on the size of the wearer and the size of the girth of the upper torso of the wearer. FIGS. 7 and 8 also show the one-way elasticity of the shoulder straps as indicated by the numeral 4.

SUMMARY OF THE INVENTION

The structure of the WSS, as explained above, transfers the weight of the breasts more to the serratus anterior, external obliques, and the intercoastal muscles where they come together at the outside edge of the breasts in conjunction with the latissimus dorsi. This alleviates the weight of the breasts from the shoulders and back of the wearer which will improve the posture. The unique pads may be molded to the actual shape of the breasts, as explained above, and are placed on a diagonal in proximity to the lateral edges where muscle tissue and corresponding ligaments, meridian channel acupressure points, nerve endings, the lymphatic system, mammary glands, and the epidermal layer engage. This places the pads in the area where the greatest pull of gravity is centered on the breasts. The pads could be sewn or adhesively fastened to the cups.

The structure of the WSS also creates an isometric exercise due to the fact that it is constructed from one piece of stretchable fabric coupled with the unique pad and fastener design and placement when employed with the unique strapping arrangement. That being that the strap from the apex of the right cup is fastened to the left side of the WSS in the area where various muscle tissue and corresponding ligaments, meridian channel acupressure points, nerve endings, and bone engage. This, of course, is also true for the other breast where the left strap is fastened to the lateral right side of the brassiere or WSS. This kind of arrangement creates a "seesaw" or ying/ying effect; where as the body is allowed to extend and to contract naturally creating a balance not resisting in the body's movement. When the right side of the wearer moves, such as an arm extension or a shoulder lift, that movement is being supported by the left side muscles. The strapping shoulder straps cross over the posterior section of the back in correspondence to the location of the wearer's breast on the anterior side and wrap around the sides of the body of the wearer where the fastening elements are located. Also the straps of the brassiere or WSS do not strain the clavicle bone or scapula muscle in the shoulder of the wearer. Because of this unique strapping arrangement, the breasts move with the whole upper torso, yet they are protected and supported by this unique strapping method, pad placement and the fastening locations. Consequently, the breasts are not held in a rigid brace and apart from the torso as is done now with existing brassieres but become one with the torso creating harmony, symmetry and balance.

The unique fastening method creates support for the individual breast. The reinforced fasteners are located on the left and right exterior region of each breast where all of the above mentioned muscles meet and engage with bone beneath the breast tissue. The fastening elements located at the ends of the straps that pass over the shoulders to support the breasts engage at opposite sides. The widened ends of the shoulder straps having the fastening elements thereon are fastened at opposite sides at the outer edges of the brassiere or WSS. That is, the right shoulder strap passes over the right shoulder of the wearer, crosses the back of the wearer and is fastened to the left outer edge of the brassiere. The same is true for the left shoulder strap which passes over the left shoulder of the wearer, crosses the back of the wearer and then is fastened to the right outer edge of the brassiere or WSS. As has been explained above, the shoulder straps crossing the back of the wearer are not left to their own design but the crossing of the shoulder straps has been brought down over the scapula parallel to the spine where they cross the small of the back to meet the latissimus dorsi, serratus anterior, external obliques, and the intercoastal muscles, and their corresponding ligaments, meridian channel acupressure points, nerve endings, and the lymphatic system in the region of the fasteners and the pads. This way, the lateral fastening of the ends of the shoulder straps takes the weight of the breasts off the spine; which houses the intricate nervous system of the human body. Existing brassieres fasten over the spine or the sternum blocking cellular communication, thus interrupting the flow of energy within the body. Movement, especially that of the upper torso, causes the fastener and protective padding to massage the muscles, thereby enhancing the flow of blood to this area. This, in connection with stimulating the acupressure points, creates a natural lift from an electrical charge that is generated and produces an experience of near weightlessness of the breast tissue in the wearer. In addition, the massaging of the lymph glands assists in lymphatic drainage, reducing harmful toxins. The lateral fastening of the shoulder straps allows this garment to be removed from the body of the wearer without the necessity to remove any outer clothing.

The unique ergonomic design of the WSS creates an isometric exercise/ experience for the breasts. Utilizing the latissimus dorsi and other surrounding muscles for support with the fastening elements located in the region of the external obliques and serratus anterior muscles, the shoulders are gently rolled in a reverse motion and the breasts are cradled not contoured producing, as previously stated, a natural lift and a supported look and feel. The breasts are suspended in such a manner to take the weight off the diaphragm, allowing expanded breathing by the wearer, bringing more oxygen into the blood supply, The freed muscle of the diaphragm massages the body to allow for proper of lymph. By activating these supportive muscles, as explained above, the weight of the breasts is being taken off the diaphragm, spinal column and shoulders, thus the clavicle, accounting for its non-indentation. This all results in an erect posture of the wearer and a feeling of well being.

What we claim is:

1. A therapeutic brassiere including a one piece directional elastic material, said elastic material having more stretch in the vertical direction than in the lateral direction as seen on a person wearing said brassiere, said directional elastic material results in self-forming cups for the breasts when worn on said person, each of said cups having an apex at their tops, shoulder straps are continuing from each of said apexes, crossing over the shoulder of a wearer, passing across the back of said wearer and means for fastening each ends of said shoulder straps to lateral and opposite edges of said brassiere under the armpit of said wearer but just forward of the armpit to cover latissumus dorsi muscles located under the skin of the wearer.

2. The therapeutic brassiere of claim 1, wherein said ends of said shoulder straps are widened and have hook elements of said means for fastening placed thereon.

3. The therapeutic brassiere of claim 2, wherein said widened ends of said shoulder straps having said hook elements thereon are reinforced.

4. The therapeutic brassiere of claim 1, wherein said lateral edges of said brassiere have loop elements of said means for fastening thereon.

5. The therapeutic brassiere of claim 4, wherein said lateral edges of said brassiere having said loops thereon are reinforced.

6. The therapeutic brassiere of claim 1 including pads for each of the breasts, each of said pads has a shape resembling a tear shape and is placed at each of the lateral sides of said brassiere.

7. The therapeutic brassiere of claim 6, wherein a major part of said tear shape of each of said pads is placed contiguous with each of said lateral edges of said brassiere.

8. The therapeutic brassiere of claim 1, wherein said shoulder straps crossing in the back of the wearer have means for pulling them down so that the said crossing substantially coincides with the small of the back of the wearer.

9. The therapeutic brassier of claim 8, wherein said means for pulling down consists of said shoulder straps being intertwined with each other prior to each being fastened at each of said edges of said brassiere.

10. The therapeutic brassiere of claim 8, wherein said means for pulling down consists of each of said shoulder straps being fastened to the other of said shoulder straps.

11. The therapeutic brassiere of claim 8, wherein said means for pulling down consists of rings fastened to each of said shoulder straps and each of said rings slidingly receiving the other of said shoulder straps.

* * * * *